US005131869A

United States Patent [19]

Wharton

[11] Patent Number: 5,131,869

[45] Date of Patent: Jul. 21, 1992

[54] ELECTRICAL ADAPTER PLUG

[75] Inventor: Richard F. Wharton, Glenview, Ill.

[73] Assignee: Safco Corporation, Chicago, Ill.

[21] Appl. No.: 586,998

[22] Filed: Sep. 24, 1990

[51] Int. Cl.[5] ..... H01R 13/68

[52] U.S. Cl. ..... 439/622; 439/669

[58] Field of Search ..... 439/622, 668, 621, 669, 439/731, 752, 686, 687, 696

[56] References Cited

U.S. PATENT DOCUMENTS

| | | | |
|---|---|---|---|
| 1,151,800 | 8/1915 | Klein | 434/731 |
| 2,489,037 | 11/1949 | Kailer | 439/668 |
| 2,954,544 | 9/1960 | Focosi | 439/668 |
| 3,099,505 | 7/1963 | Schwartz | 439/668 |
| 3,377,610 | 4/1968 | Busch | 439/622 |
| 3,865,463 | 2/1975 | Busch | 439/668 |
| 4,322,122 | 3/1982 | Schwartz et al. | 439/621 |

FOREIGN PATENT DOCUMENTS

| | | | |
|---|---|---|---|
| 0693054 | 7/1940 | Fed. Rep. of Germany | 439/696 |
| 0057580 | 3/1989 | Japan | 439/622 |
| 0209441 | 7/1940 | Switzerland | 439/696 |

*Primary Examiner*—David L. Pirlot
*Assistant Examiner*—Kevin J. Carroll
*Attorney, Agent, or Firm*—Augustus G. Douvas

[57] ABSTRACT

An electrical adapter plug having a body insertable into a mating socket sleeve of a vehicle lighter receptacle. The plug has a pair of ideally located circumferentially-spaced, retractable leaf-spring contacts projecting beyond the periphery of the plug body to establish improved retention and electrical contact between the adapter plug and the receptacle. The two contacts are preferably angularly spaced on the periphery of the plug at about 90° and associated with projecting means located on the periphery of the plug body generally opposite the pair of contacts symetrically disposed on or about a line which bisects the space angle between the two contacts. An adapter plug fuse is retained in a socket defined by a fuse insert housed within a central cavity formed by the adapter plug. This fuse insert assists in holding two body halves together and also anchors the long leaf-spring contacts. The fuse insert enables the adapter plug body to be held together by a single fastening screw and locking fingers rather than cement, glue or welding. This screw and finger design permits repair of a defective plug which is not possible with cemented, glued or welded adapter-plug body sections.

14 Claims, 3 Drawing Sheets

ELECTRICAL ADAPTER PLUG

BACKGROUND OF THE INVENTION

This invention relates to electrical connecting devices, and particularly to an electrical adapter plug which may be inserted into the sockets or receptacles of automotive cigarette lighter assemblies so that various low voltage loads may be operated by the electrical system of the vehicle.

In recent years, a great variety of electrical appliances have become available for operation by the low voltage, direct-current power of the electrical systems of cars, power boats, and campers. The appliance is generally interconnected to the electrical system of the vehicle by use of an adapter plug or connector which is inserted into the cigarette lighter socket or receptacle. Electrical appliances and accessories which can be operated from a vehicle electrical system vary widely and include portable television sets, tape recorders, trouble lights, window defrosters, electric shavers, electric toothbrushes, can openers, food mixers, and the like.

Such prior art devices useful for electrical connection with cigarette lighter receptacles include Focosi U.S. Pat. No. 2,954,544, Schwartz U.S. Pat. No. 3,099,505, Busch et al U.S. Pat. No. 3,377,610 and Busch U.S. Pat. No. 3,865,463.

In general, existing adapter plug designs each have one or two spring contacts mating with a receptacle sleeve. If there are two contacts, they are usually angularly spaced to project from the periphery of an adapter plug body at an angle of 180°. Accordingly, the vector sum of the mechanical forces of two contacts within the sleeve are in-line or 180° opposing and there is zero force on the body of the adapter plug to position it against the receptacle surface. Thus the adapter plug is able to pivot on the in-line contact points within the receptacle. When the adapter plug is free to pivot more, it can loosen and eventually lose electrical contact when subject to vibration or shock.

I disclosed in my U.S. Pat. No. 4,998,315 issued Jan. 29, 1991 for Electrical Adapter Plug a novel electrical adapter plug design having a pair of spaced electrical spring contacts located on the periphery of an adapter plug body. These contacts cooperate with a diametrically opposite groove in a first preferred embodiment to establish improved mating contact with the cylindrical sleeve of a cigarette lighter receptacle when the adapter plug is manually inserted into the receptacle. In particular, two negative or side contacts on the adapter plug are positioned to provide a force on the body of the adapter plug resulting in better contact engagement with the receptacle sleeve. The two spring contacts are radially positioned opposite each other at an included angle of less than 180°. The resultant vector force effects a peripheral contact of the adapter plug to the receptacle sleeve (and depending upon the particular preferred embodiment employed) a stable two point and a one line or alternatively a two line engagement of the mated adapter plug and receptacle sleeve.

In a first preferred embodiment shown in my earlier application, a groove is strategically located on the periphery of the adapter plug body diametrically opposite the electrical contacts and centered on a line which represents an extension of the resultant force vector generated by the two spring contacts. The two sidewall edges, Which define the groove, make a spaced two-line contact with the receptacle sleeve.

Accordingly, the adapter plug makes contact with the sleeve of the receptacle in four areas, namely, the two lines which define the two edges of the groove and the two spring contact points. This four area mating contact between the adapter plug and its receptacle greatly improves the retention of the adapter plug in the receptacle.

Prior art adapter plug designs which are commercially available have one or two electrical spring contacts mating with the receptacle sleeve. If there are two contacts, they are 180° opposing. It is noted, however, U.S. Pat. No. 2,489,037 issued Nov. 22, 1949 discloses a non-commercial adapter plug having contacts located at an included angle of 90°. This patented design does not use a groove, or other equivalent means, to establish line contact with the inner wall of the receptacle.

This in-line disposition of forces enables the adapter plug to pivot on the in-line contact areas (or points) established with the receptacle. When the adapter plug is free to pivot or move, it can loosen and eventually break electrical contact when subjected to vibration or jarring.

In a second preferred embodiment shown in my earlier application, the periphery of the adapter plug body is formed with a protruding portion (the groove of the first embodiment is eliminated) diametrically opposite the electrical contacts and centered on a line which represents an extension of the resultant force vector generated by the two spring contacts. The resultant vector force effects contact of the adapter plug to the receptacle sleeve in three spaced areas, namely the two spaced spring contact points and the line of contact between the protruding portion and the receptacle sleeve.

A third preferred embodiment is also described in my earlier application which features a flat adapter-plug body portion (in lieu of a groove) to define two line contact areas which function similar to the groove edges.

SUMMARY OF THE INVENTION

The adapter plug designs of my earlier application for patent increase the forces which retain an adapter plug within a mating receptacle; and similarly the force required to withdraw the adapter plug from the receptacle is also increased. If the receptacle has a relatively small bore, the retention and withdrawal forces may be excessive and thus troublesome.

An ideal adapter plug design would require the same optimum force (or from an equivalent viewpoint the same resistance to withdrawal) without regard to the bore size of the receptacle. The difficulty in attaining this idea force requirement is explained in part by noting that for cigarette lighter receptacles the largest European size is approximately 0.890 inch I.D. and the smallest U.S. receptacle has a 0.824 inch I.D, If a single size adapter plug could be designed having a narrow range of retention forces and also withdrawal forces for various size receptacles, manufacturing economics would ensue.

Accordingly, a principal object of this invention is to provide an improved electrical adapter plug for which the forces of retention and also withdrawal have a relatively narrow range when a single-size adapter plug is used with different receptacles having a wide range of bore sizes.

Another object is to attain the economies of cost, manufacture and inventory by providing a single size electrical adapter plug for different receptacles having a wide range of bore sizes.

Another object is to provide an adapter plug having the novel designs described in this specification and characterized by long leaf-spring side contacts in which the adapter plug body sections are held together by a screw and not by glue, cement or ultrasonic welding.

The foregoing objects are attained in the present invention by a novel adapter plug design feature having side leaf-spring contacts which are characterized substantially by the maximum flexing length permitted by the adapter plug body length. The use of long leaf-spring contacts create a very flat spring-flexing rate, that is a low rate of increase of side contact force with deflection of the side contact. This allows the adapter plug to have essentially the same retention force and withdrawal force whether the receptacle is the European receptacle or the smallest U.S. receptacle.

The long leaf-spring contacts are preferably incorporated in an adapter plug housing fabricated in accordance with the angular side contact displacement, and the several preferred embodiments of line contact arrangements involving either a groove or one or more projections to effect line contact(s) with the receptacle housing as taught in my earlier U.S. Pat. No. 4,988,315 issued Jan. 29, 1991.

In this invention the adapter plug body features a novel fuse insert captured between the two housing halves held together by a single screw engaging the fuse insert. The fuse insert serves as a support for both long leaf-spring contacts and the conventional tubular fuse associated with the positive adapter-plug tip contact. The leaf-spring contacts extend the length of the insert. The insert is also used to latch into one of the housing halves thereby holding the two body halves together.

The fuse-insert design enables the adapter-plug body halves to be held together by a single screw notwithstanding the fact that the leaf-spring contacts are both angularly displaced 90°. Prior art plugs employing long leaf-spring contacts have body halves which are glued or cemented together and therefore cannot be repaired.

DESCRIPTION OF THE DRAWINGS

In order that all of the structural features for attaining the objects of this invention may be readily understood, reference is herein made to the drawings wherein.

DETAILED DESCRIPTION OF THE PREFERRED EMBODIMENT

Figure 1:
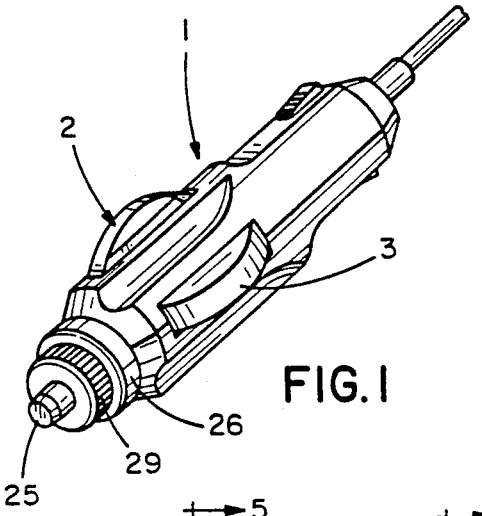
FIG. 1 is a perspective view of the adapter plug of this invention.

A first preferred embodiment of electrical adapter plug 1 of this invention is shown in FIGS. 1 through 11. A principal novel structural feature of this invention relates to an adapter-plug having body halves held together by a single fastening screw and associated with the very long (maximum) length employed in leaf-spring side contacts 2 and 3 in order to attain a very flat spring rate. This very flat spring rate provides a low rate of increase of side contact force with deflection of the side contact. As previously explained, this low rate enables the forces of retention and also withdrawal to be limited to a narrow range to enable a single-size adapter plug to be used with different receptacles having a wide range of bore sizes.

A second principal novel feature relates to fuse insert 4 located within the central cavity defined by body halves 5 and 6. With a 90° angular disposition of leaf-spring contacts 2 and 3 on the periphery of the adapter plug body defined by halves 5 and 6 and using long contacts 2 and 3 in the middle of the body, it is impossible to provide a satisfactory socket for the conventional tubular fuse 7 without the inclusion of insert 4. In the novel design of this invention, insert 4 latches onto one of the body halves thereby holding the two body halves together as well as providing a chamber for containing fuse 7.

The theory explaining the advantages of the 90° angular disposition of contacts 2 and 3 (angle A in FIG. 2), and also the location of groove 8 generally opposite the pair of contacts 2 and 3 and generally centered on a vector line V (FIG. 2) which represents an extension of the resultant force vector generated by the retraction of the two contacts is set forth in detail in my U.S. Pat. No. 4,998,315. A brief review of this theory is necessary for a full understanding of how the improvements of this invention are related to the structure of U.S. Pat. No. 4,988,315.

Commercial adapter plugs now in the prior art either have one or two electrical spring contacts engaging an associated receptacle. The retention obtained from a single contact is generally unsatisfactory in environments subject to vibration. Similarly, while improved retention is obtained in designs employing two spring contacts, these contacts are disposed diametrically opposite one another on the periphery of the adapter plug body. This in-line disposition of spring forces generated by the 180° opposing spring contacts permits the adapter plug to pivot on the in-line spring contact areas (points) established with the receptacle. The result is a less than optimum retention which is only marginally satisfactory.

As explained in my earlier patent, there are several important design parameters that govern the relative disposition of spring contacts 2 and 3 and groove 8 defined by line edges 9 and 10 The included angle A (FIG. 2) must be less than 180°, and preferably the angle should be in the range of about 20° to 150°.

Figure 2:
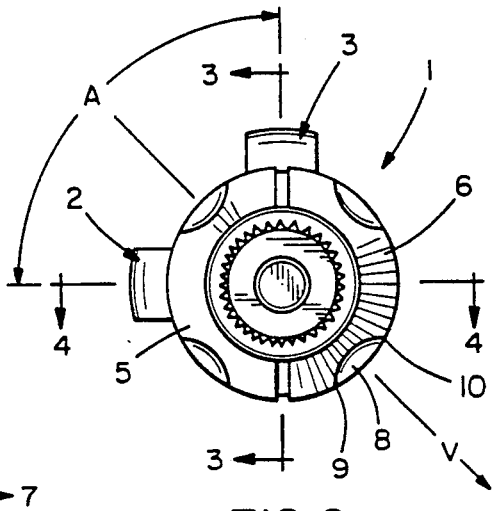
FIG. 2 is an elevation view of the positive-contact end of the adapter plug.
Figure 3:
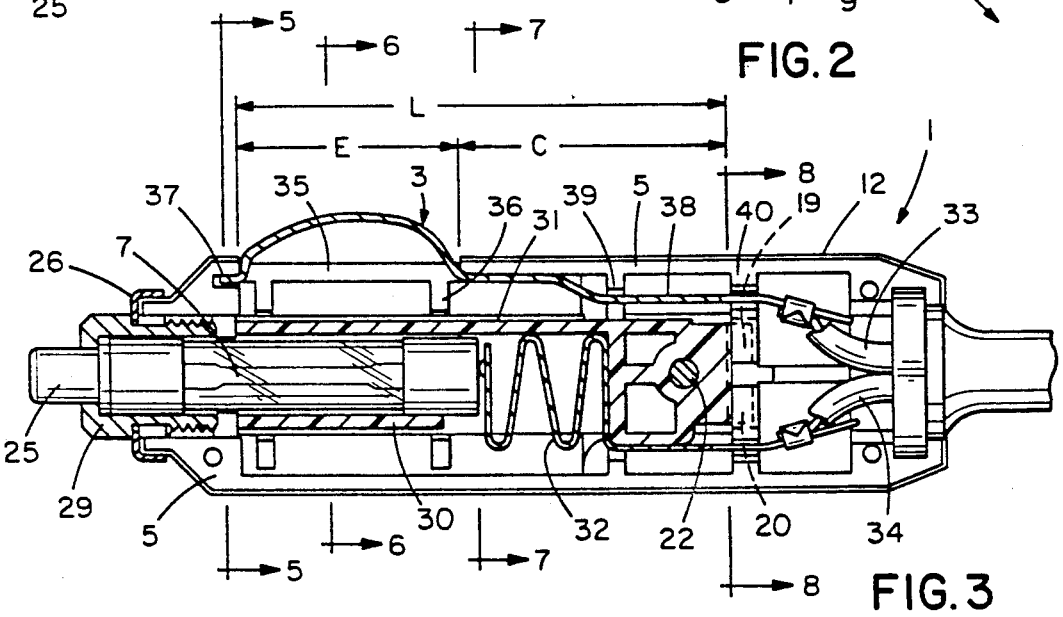
FIG. 3 is a section view taken along line 3—3 of FIG. 2 which shows the active negative spring contact, and also certain details of the internal construction of the adapter plug.
Figure 4:
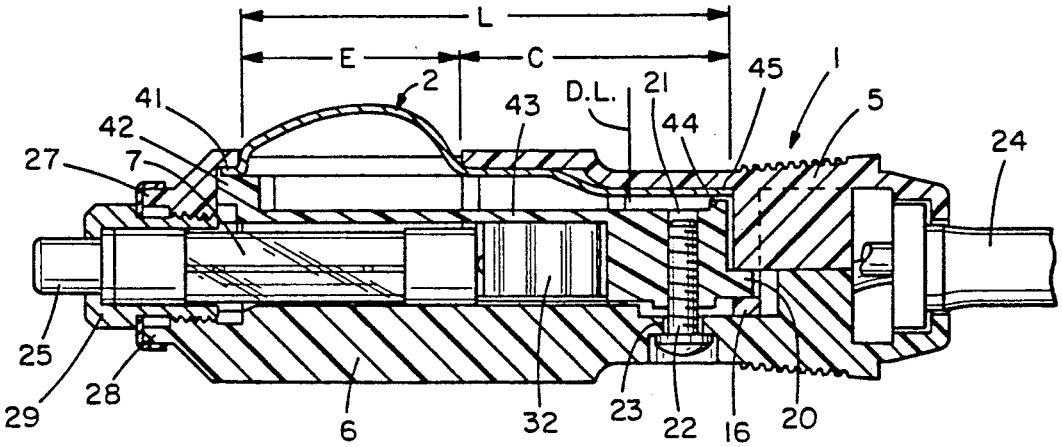
FIG. 4 is a section view taken along line 4—4 of FIG. 2 which shows the inactive (dummy) negative spring contact as well as another view of the internal construction of the adapter plug.
Figure 5:
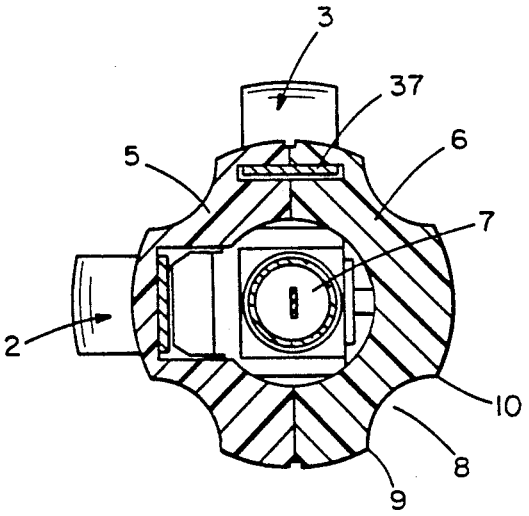
FIGS. 5, 6, 7 and 8 are a set of section views taken along lines 5—5, 6—6, 7—7 and 8—8 of FIG. 3 which also show the internal construction of the adapter plug including the position of both the active and inactive negative spring contacts when the adapter is removed from a receptacle.
Figure 6:
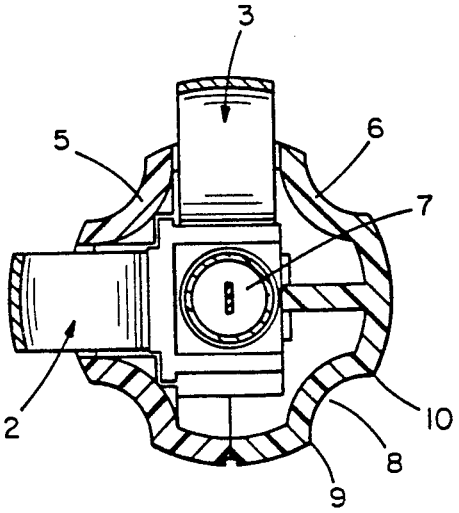
Figure 7:
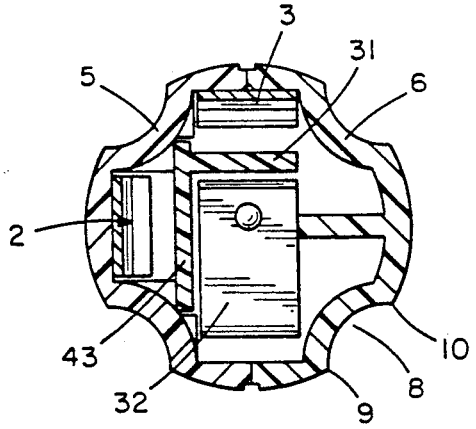
Figure 8:
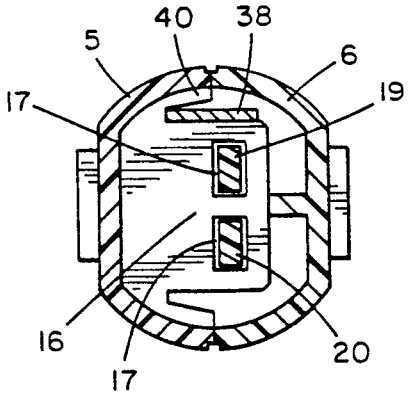

In the first embodiment shown in FIGS. 1 through 11, angle A is about 90° As this angle is increased to greater than 90°, the resultant force vector V FIG. 2) exerted against line edges 9 and 10 is decreased; and as this angle is decreased the vector V is increased. However, in both cases substantial angle A deviations from 90° enables adapter plug 1 to pivot more easily due to decreased retention.

Groove 8 is optimumly located on the periphery of adapter plug 1 generally opposite electrical leaf-spring contacts 2 and 3 so as to be centered on a force line V which represents an extension of the resultant force vector generated by the two spring contacts 2 and 3 when mated with receptacle 12. Groove 8 is generally aligned lengthwise with the longitudinal axis of the plug.

Figure 12:
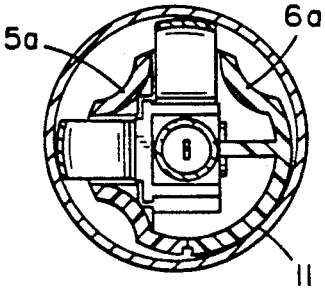
FIG. 12 is a view related to FIG. 11 which substitutes a single projecting portion for the two line contacts established by the groove of FIG. 11.

An alternative to groove 8 is shown in the cross-section view of FIG. 12. In this configuration, adapter plug 1 is also formed with two joined plastic body halves 5*a* and 6*a*. The periphery of the resulting plug body omits groove 8 of the first embodiment and is contoured to define an elongated projection 11 generally aligned lengthwise with the longitudinal axis of the plug. In this embodiment, three distinct areas of mating contact are established between adapter plug 1 and receptacle 12. In particular, point contacts are established by leaf-spring contacts 2 and 3 and a single line contact is formed by elongated projection 11. The retention provided by elongated projection 11 is somewhat less than that provided by groove 8, but it is satisfactory for applications not involving vibration.

Figure 13:
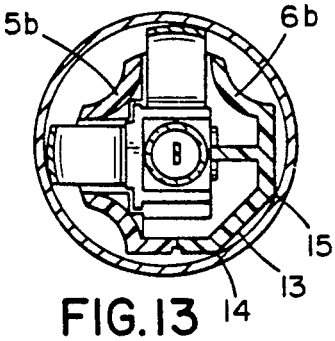
FIG. 13 is a view related to FIGS. 11 and 12 which substitutes a flat adapter-plug body portion for the groove of FIG. 11 and the single projecting portion of FIG. 12.
Figure 14:
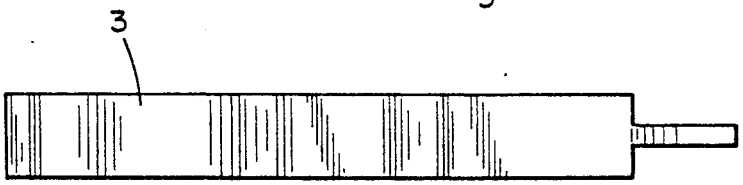
FIG. 14 is a plan view of the active negative spring contact.
Figure 15:
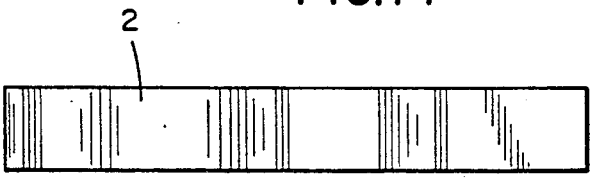
FIG. 15 is a plan view of the dummy negative spring contact.
Figure 16:
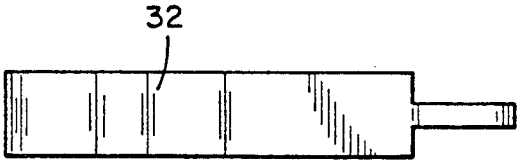
FIG. 16 is a plan view of the positive fuse contact.

A second alternative to groove 8 is shown in the cross-section view of FIG. 13. In this configuration, adapter plug 1 is also formed with two joined plastic body sections 5*b* and 6*b*. Body section 6*b* is formed with a flat portion 13 defined by two elongated line edges 14 and 15. These edges are aligned with the longitudinal axis of the adapter plug.

Edges 14 and 15 make two line contact with receptacle 12 when adapter plug 11 is inserted within receptacle 12. The four area contact provided by the embodiment of FIG. 13 functions to provide plug retention in a manner which is essentially identical to that provided by groove edges 9 and 10.

The essential requirement in the groove 8 embodiment, or the alternatives of FIGS. 12 and 13 is that the adapter plug design employ angularly spaced point contacts effected by at least a pair of retractable spring contacts. These point contacts must cooperate with one or two line contacts located either generally on (in the case of one line), or in the case of two spaced lines preferably symmetrically disposed, with respect to a diametrically extended line which bisects the angle between the two spaced contacts. This extended line also represents the resultant force vector generated by the two spring contacts.

Figure 17:
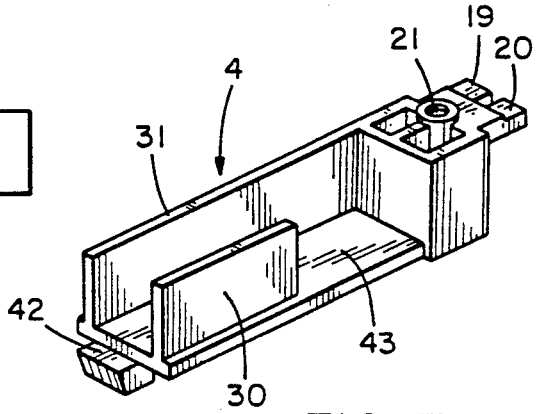
FIG. 17 is a perspective view of the fuse insert.

Referring now to the structural features of the present invention, shown in FIGS. 1 through 11, plastic body halves 5 and 6 define an internal cavity which houses plastic fuse insert 4 (FIG. 17). Body half 5 is appropriately designated the male half because it is formed with an integral riblike locking tongue 16 (FIG. 8) which projects into the portion of the internal cavity defined by female body half 6. Locking tongue 16 has two aligned rectangular holes 17 and 18 which are engaged by a mating pair of latching fingers 19 and 20 (FIG. 17) which project from the right end of tubular insert 4. This insert end also contains a threaded hole 21 (FIGS. 4 and 9) which receives plastic fastening screw 22 which passes through a recessed hole 23 formed in female body half 6. Accordingly, the engagement of locking tongue 16 by latching fingers 19 and 20, and thus body halves 5 and 6, fastens together the cord 24 end of adapter plug 1.

The opposite end of adapter plug 1 containing positive contact tip 25 is fastened together by metallic flanged holding ring 26 which is tightly seated on the semi-circular ends 27 and 28 of body halves 5 and 6 by threaded tip retainer 29.

Figure 9:
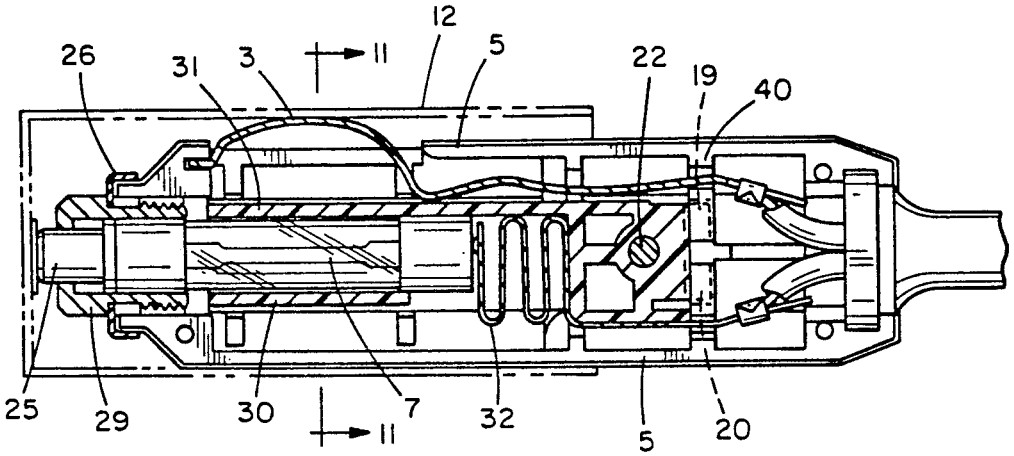
FIG. 9 is a section view (related to the section view of FIG. 3) which shows the adapter plug inserted into a receptacle with the active negative spring contact being in a depressed state.
Figure 10:
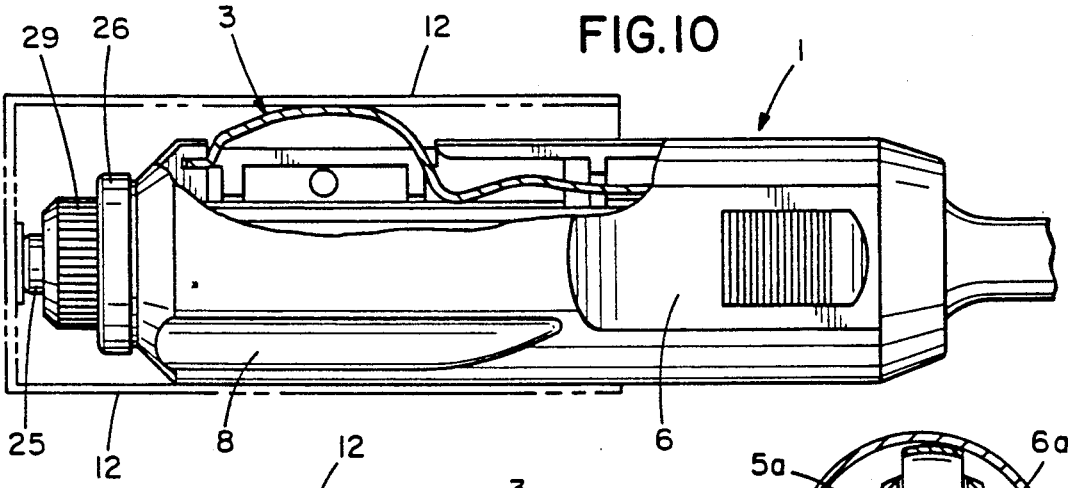
FIG. 10 is a view which shows the exterior of the adapter plug housing with a portion of the housing being broken away to show the compressed position of the active negative spring contact.
Figure 11:
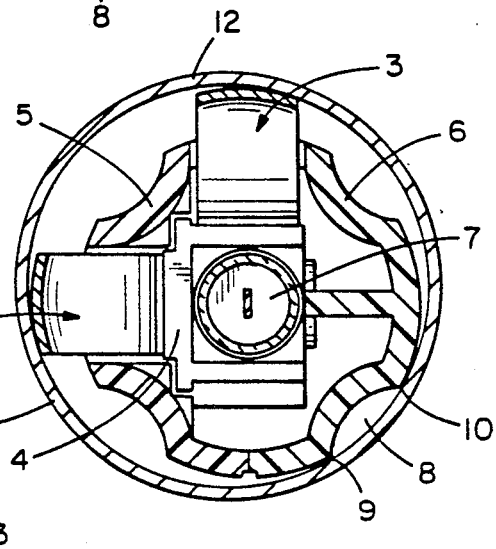
FIG. 11 is a section view taken along line 11—11 of FIG. 9 which shows the engagement or line-contact areas established between the adapter plug groove and a receptacle.

Tubular fuse 7 is partially lodged between spaced insert walls 30 and 31, and is sandwiched between positive contact tip 25 and pleated positive conductor 32. The pleated section of conductor 32 serves as a biasing spring to project positive contact tip 25 outwardly. Contact tip 25 is retracted into adapter plug 1 when the plug is inserted into receptacle 12 (FIG. 9). This action compresses the pleated section of conductor 32 enabling fuse 7 to move deeper into insert 4.

Leaf-spring contacts 2 and 3 have very long flexing body sections which depress relative the body of adapter plug 1 in response to plug insertion into receptacle 12.

Leaf-spring contact 3 is the active negative contact of plug 1 because of its direct connection to negative line conductor 33 (FIG. 3), and pleated positive conductor 32 is also active because of its direct connection to positive line conductor 34, leaf-spring contact 2 is a dummy or inactive negative contact because in the particular embodiment shown in the drawing it is a "free-floating" contact not connected to any line conductor. If desired, however, contact 2 could be made an active contact by simply connecting it to contact 3 or line conductor 33.

Active leaf-spring contact 3 has a flexing section L (FIG. 3) consisting of an arched section E (exposed) projecting through body rectangular slot 35 and a relatively flat section C (confined) lodged within interior body cavity 36. In a preferred embodiment section E is approximately 0.740" long, and section C is approximately 880" long.

Contact 3 is formed with an anchor tip 37 that is anchored into a mating recess formed in body half 5; and the opposite end of contact 3 is formed with a non-flexing support section 38 that is curved to pass below rib 39 and motion restrained by rib 40. Active leaf-spring contact 3 assumes the distorted depressed contour shown in FIG. 9 in response to insertion of adapter plug 1 into receptacle 12.

In a preferred embodiment, inactive (dummy) leaf-spring contact 2 is formed with dimensions L,E and C (FIG. 4) that are identical to dimensions L, E and C respectively, for active contact 3.

Contact 2 is formed with anchor tip 41 that is anchored into mating recess defined by body 5 and insert support projection 42 (FIGS. 4 and 7) cantilevered from insert case 43. The opposite end 45 of contact 2 is restrained by insert support projection 44 (FIG. 4) and body half 5.

Because leaf-spring contacts 2 and 3 are relatively long with respect to the body of adapter plug 1 (which is 2.76 inches long in a preferred commercial embodiment), the forces of plug retention and also withdrawal have a relatively narrow range when a single-size adapter plug is used with different receptacles having a wide range of bore sizes.

The use of long leaf-spring contacts 2 and 3 angularly spaced at about a 90° angle using prior art adapter-plug designs requires the typical two plug body sections to be glued, Cemented or ultrasonically welded together. An adapter plug that is so joined cannot be disassembled for repair and thus must be discarded. A fastening screw cannot be used because it would intersect and hit one of the contacts harming electrical performance. The novel fuse-insert 4 design of this invention enables the adapter-plug body halves 5 and 6 to be screwed together so as to be repairable.

Moreover, without the novel fuse-insert 4 design, (dummy) leaf-spring contact 2 could only extend to line D, L. (FIG. 4) otherwise contact 2 would interfere with a long screw (not shown) which would join body halves 5 and 6. This screw would be located on the same axis as fastening screw 22.

It should be understood that the above-described structures are merely illustrative of the preferred embodiments of this invention. Modifications can be made without departing from the scope of the invention.

What is claimed is:

1. An electrical adapter plug insertable into a mating receptacle to establish electrical contact between the plug and the receptacle, comprising a pair of elongated body sections mated to form an adapter plug body defining an internal cavity, a fuse insert defining a fuse socket with the insert being housed at least partially within the internal cavity, a pair of angularly spaced leaf spring contacts with each contact having a first section positioned within the internal cavity external to the fuse insert and a second section projecting beyond the adapter plug body to make mechanical contact with the receptacle, and means locking adjacent ends of each body section to the fuse insert in which the locking means effects its lock solely through the fuse insert.

2. The electrical adapter plug of claim 1 comprising a contact tip projecting from a first end of the elongated adapter plug body and one or more line conductors projecting from a second end of the adapter plug body opposite the first end with the locking means being located generally towards the second end of the adapter plug body to lock principally the adapter body sections adjacent the second end.

3. An electrical adapter plug insertable into a mating receptacle to establish electrical contact between the plug and the receptacle, comprising a pair of elongated body sections mated to form an adapter plug body defining an internal cavity, a fuse insert defining a fuse socket with the insert being housed at least partially within the internal cavity, a pair of angularly spaced leaf-spring contacts with each contact having a first section positioned within the internal cavity external to the fuse insert and a second section projecting beyond the adapter plug body to make mechanical contact with the receptacle, and means locking adjacent ends of each body section to the fuse insert in which the locking means includes a first mechanical fastener joining one of the body sections to the fuse insert and a second mechanical fastener separately joining the second body section to the fuse insert.

4. The electrical adapter plug of claim 1 in which the locking means includes a first mechanical fastener joining one of the body sections to the fuse insert and a second mechanical fastener separately joining the second body section to the fuse insert.

5. The electrical adapter plug of claim 3 in which the first mechanical fastener is a threaded screw and the second mechanical fastener includes one or more fingers integral with and projecting from the fuse insert and an apertured element integral with the second body section with the one or more fingers engaging the apertured element.

6. The electrical adapter plug of claim 4 in which the first mechanical fastener is a threaded screw and the second mechanical fastener includes one or more fingers integral with and projecting from the fuse insert and an apertured element integral with the second body section with the one or more fingers engaging the apertured element.

7. The electrical adapter plug of claim 5 in which the leaf-spring contacts are angularly spaced on the periphery of the adapter plug in the range of 150° to 20°.

8. The electrical adapter plug of claim 6 in which the leaf-spring contacts are angularly spaced on the periphery of the adapter plug in the range of 150° to 20°.

9. The electrical adapter plug of claim 7 in which the leaf-spring contacts are angularly spaced at about 90° and are retractable into the adapter plug body when the body is inserted into the mating receptacle.

10. The electrical adapter plug of claim 8 in which the leaf-spring contacts are angularly spaced at about 90°.

11. The electrical adapter plug of claim 9 comprising projecting means located on the periphery of the adapter plug body generally opposite the pair of contacts and generally centered on a line which represents an extension of a resultant force vector generated by the retraction of the two spring contacts in response to the insertion of the adapter plug into the mating receptacle so that at least three areas of contact exist between the adapter plug and the receptacle which contact areas include the leaf-spring contacts and the projecting means.

12. The electrical adapter plug of claim 10 comprising pojecting means located on the periphery of the adapter plug body generally opposite the pair of contacts and generally centered on a line which represents an extension of a resultant force vector generated by the retraction of the two spring contacts in response to the insertion of the adapter plug into the mating receptacle so that at least three areas of contact exist between the adapter plug and the receptacle which contact areas include the leaf-spring contacts and the projecting means.

13. An electrical adapter plug insertable into a mating receptacle to establish electrical Contact between the plug and the receptacle, comprising a pair of elongated body sections mated to form an elongated adapter plug body defining an internal cavity, a fuse insert defining a fuse socket with the insert being housed within the internal cavity, a pair of angularly spaced leaf-spring contacts with each contact having a first section positioned within the internal cavity and a second section projecting beyond the adapter plug body to make electrical contact with the receptacle, a mechanical fastener joining the fuse insert and one of the body sections, and a pair of mating locking elements locking the other body section and the fuse insert together.

14. The electrical adapter plug of claim 13 in which the fuse insert is generally elongated and having a longitudinal axis generally aligned with the longitudinal axis of the elongated adapter plug body.

* * * * *